US009574533B2

(12) United States Patent
Monaghan et al.

(10) Patent No.: US 9,574,533 B2
(45) Date of Patent: Feb. 21, 2017

(54) FUEL INJECTION NOZZLE AND METHOD OF MANUFACTURING THE SAME

(71) Applicant: General Electric Company, Schenectady, NY (US)

(72) Inventors: James Christopher Monaghan, Moore, SC (US); Thomas Edward Johnson, Greer, SC (US); Heath Michael Ostebee, Easley, SC (US)

(73) Assignee: General Electric Company, Schenectady, NY (US)

( * ) Notice: Subject to any disclaimer, the term of this patent is extended or adjusted under 35 U.S.C. 154(b) by 376 days.

(21) Appl. No.: 13/916,767

(22) Filed: Jun. 13, 2013

(65) Prior Publication Data

US 2014/0367495 A1 Dec. 18, 2014

(51) Int. Cl.

| | |
|---|---|
| ***B05B 7/04*** | (2006.01) |
| ***B05B 7/08*** | (2006.01) |
| ***F02M 55/00*** | (2006.01) |
| ***F23R 3/28*** | (2006.01) |
| ***F23R 3/10*** | (2006.01) |

(52) U.S. Cl.

CPC ..... *F02M 55/008* (2013.01); *F23R 3/10* (2013.01); *F23R 3/28* (2013.01); *F23R 3/286* (2013.01); *B05B 7/04* (2013.01); *B05B 7/08* (2013.01); *F02M 2200/80* (2013.01); *Y10T 29/494* (2015.01)

(58) Field of Classification Search

CPC .. B05B 1/14; B05B 15/00; B05B 1/20; B05B 7/00; B05B 7/04; B05B 7/08; B05B 7/0876; B05B 7/0884; B05B 7/0892; B05B 9/00; B05B 9/03; B05B 17/00; B05B 17/04; F02C 1/00; F02M 55/008; F02M 63/00; F23R 3/045; F23R 3/20; F23R 3/26; F23R 3/28; F23R 3/283; F23R 3/286

USPC ..... 239/429–431, 737, 132, 533.2, 558, 239/132.3, 427, 548, 553, 553.3, 557, 239/590, 590.3; 60/723, 737, 738, 740, 60/742, 747

See application file for complete search history.

(56) References Cited

U.S. PATENT DOCUMENTS

| | | | | |
|---|---|---|---|---|
| 4,100,733 | A * | 7/1978 | Striebel | F23R 3/286 239/419.3 |
| 6,983,600 | B1 | 1/2006 | Dinu et al. | |
| 7,093,438 | B2 | 8/2006 | Dinu et al. | |
| 8,112,999 | B2 | 2/2012 | Zuo | |
| 8,181,891 | B2 * | 5/2012 | Ziminsky et al. | 239/430 |
| 9,267,690 | B2 * | 2/2016 | Stoia | F23R 3/283 |

(Continued)

*Primary Examiner* — Arthur O Hall
*Assistant Examiner* — Christopher R Dandridge
(74) *Attorney, Agent, or Firm* — Armstrong Teasdale LLP

(57) ABSTRACT

A fuel injection head for use in a fuel injection nozzle comprises a monolithic body portion comprising an upstream face, an opposite downstream face, and a peripheral wall extending therebetween. A plurality of pre-mix tubes are integrally formed with and extend axially through the body portion. Each of the pre-mix tubes comprises an inlet adjacent the upstream face, an outlet adjacent the downstream face, and a channel extending between the inlet and the outlet. Each pre-mix tube also includes at least one fuel injector that at least partially extends outward from an exterior surface of the pre-mix tube, wherein the fuel injector is integrally formed with the pre-mix tube and is configured to facilitate fuel flow between the body portion and the channel.

8 Claims, 6 Drawing Sheets

(56) References Cited

U.S. PATENT DOCUMENTS

| | | | | |
|---|---|---|---|---|
| 2004/0003599 | A1* | 1/2004 | Ingram | F23R 3/50 60/804 |
| 2010/0008179 | A1 | 1/2010 | Lacy et al. | |
| 2011/0057056 | A1* | 3/2011 | Ziminsky | F23D 14/48 239/398 |
| 2011/0173893 | A1* | 7/2011 | Zanetti | E05D 15/1047 49/363 |

* cited by examiner

FUEL INJECTION NOZZLE AND METHOD OF MANUFACTURING THE SAME

FEDERAL RESEARCH STATEMENT

This invention was made with Government support under Contract No. DE-FC26-05NT42643, awarded by the Department of Energy (DOE), and the Government has certain rights in this invention.

BACKGROUND OF THE INVENTION

The embodiments described herein relate generally to gas turbine engine injection nozzles, and more specifically, to pre-mix tubes that include a fuel injector used in gas turbine engine injection nozzles.

At least some known turbine engines are used in cogeneration facilities and power plants. Such engines may have high specific work and high power-per-unit mass flow requirements. To increase the operating efficiency, at least some known turbine engines, such as gas turbine engines, may operate with increased combustion temperatures. Generally, in at least some of such known gas turbine engines, engine efficiency increases as combustion gas temperatures increase. However, operating known turbine engines with higher temperatures may also increase the generation of polluting emissions, such as oxides of nitrogen ($NO_X$). In an attempt to reduce the generation of such emissions, at least some known turbine engines include improved combustion system designs. For example, many combustion systems may use premixing technology that includes fuel injection nozzles or micro-mixers that mix substances, such as diluents, gases, and/or air with fuel to generate a fuel mixture for combustion.

Certain known gas turbine fuel injection nozzles contain many small pre-mix tubes that receive air through a main inlet, and fuel through at least one fuel injector along the length of the tube. Each pre-mix tube is positioned between upstream and downstream plates and is surrounded by a peripheral wall that forms a fuel nozzle head. The fuel injectors typically include a plurality of very small, low-angle, openings within the walls of the pre-mix tubes that enable fuel to be injected from the nozzle head into the interior of the tubes, wherein the fuel and air can mix before exiting the tubes and entering a combustion chamber. Fuel injectors having a longer length facilitate enhanced mixing and therefore, enable increased operating efficiency and decreased emissions. However, the length of the fuel injector is generally limited by the thickness of the pre-mix tube, and tube thickness is generally limited by industry manufacturing standards and a desire to include as many tubes as possible within the fuel nozzle.

It should be appreciated that the above-descried fuel injection nozzles include many braze joints at the tube/plate and plate/wall interfaces that are required to seal the fuel. As a result, expensive EDM procedures are necessary to form the many small, low-angle fuel injection holes. In addition, intricate assembly methods are often required to meet specified performance criteria. As such, a need exists for a pre-mix tube that uses a longer fuel injector and that is manufactured with fuel nozzle geometries that reduce potentially leaky joints, and that reduces a need for post machining and/or EDM operations.

BRIEF DESCRIPTION OF THE INVENTION

In one aspect, a fuel injection head for use in a fuel injection nozzle is provided. The fuel injection head comprises a monolithic body portion comprising an upstream face, an opposite downstream face, and a peripheral wall extending therebetween. A plurality of pre-mix tubes are integrally formed with and extend axially through the body portion. Each of the pre-mix tubes comprise an inlet adjacent the upstream face, an outlet adjacent the downstream face, and a channel extending between the inlet and the outlet. Each pre-mix tube also includes at least one fuel injector that at least partially extends outward from an exterior surface of each of the plurality of pre-mix tubes, wherein the fuel injector is integrally formed with the pre-mix tube and is configured to facilitate fuel flow between the body portion and the channel.

In another aspect, a fluid flow conduit is provided. The fluid flow conduit comprises a first fluid inlet configured to receive a first fluid, a first fluid outlet, and a conduit wall defining a first fluid flow channel that extends between the first fluid inlet and the first fluid outlet. The fluid flow conduit further includes at least one injector portion that at least partially extends outwardly from the conduit wall. Each injector portion is formed integrally with the conduit wall includes an injector surface, a second fluid inlet defined in the injector surface, and a second fluid flow channel that extends through the conduit wall and is in flow communication with the first fluid channel.

In yet another aspect, a method of manufacturing a fuel injection head for use in a fuel injection nozzle is provided. The method comprises forming a monolithic body portion including an upstream face, an opposite downstream face, and a peripheral wall extending therebetween. A plurality of pre-mix tubes are formed such that each pre-mix tube extends axially through the body portion. Each of the pre-mix tubes is formed integrally with the body portion and includes an inlet adjacent the upstream face, an outlet adjacent the downstream face, and a channel extending between the inlet and the outlet. The method further comprises forming at least one fuel injector at least partially extending outward from an exterior surface of each pre-mix tube, wherein the fuel injector is integrally formed with the pre-mix tube and is configured to facilitate fuel flow between the body portion and the channel.

DETAILED DESCRIPTION OF THE INVENTION

Figure 1:
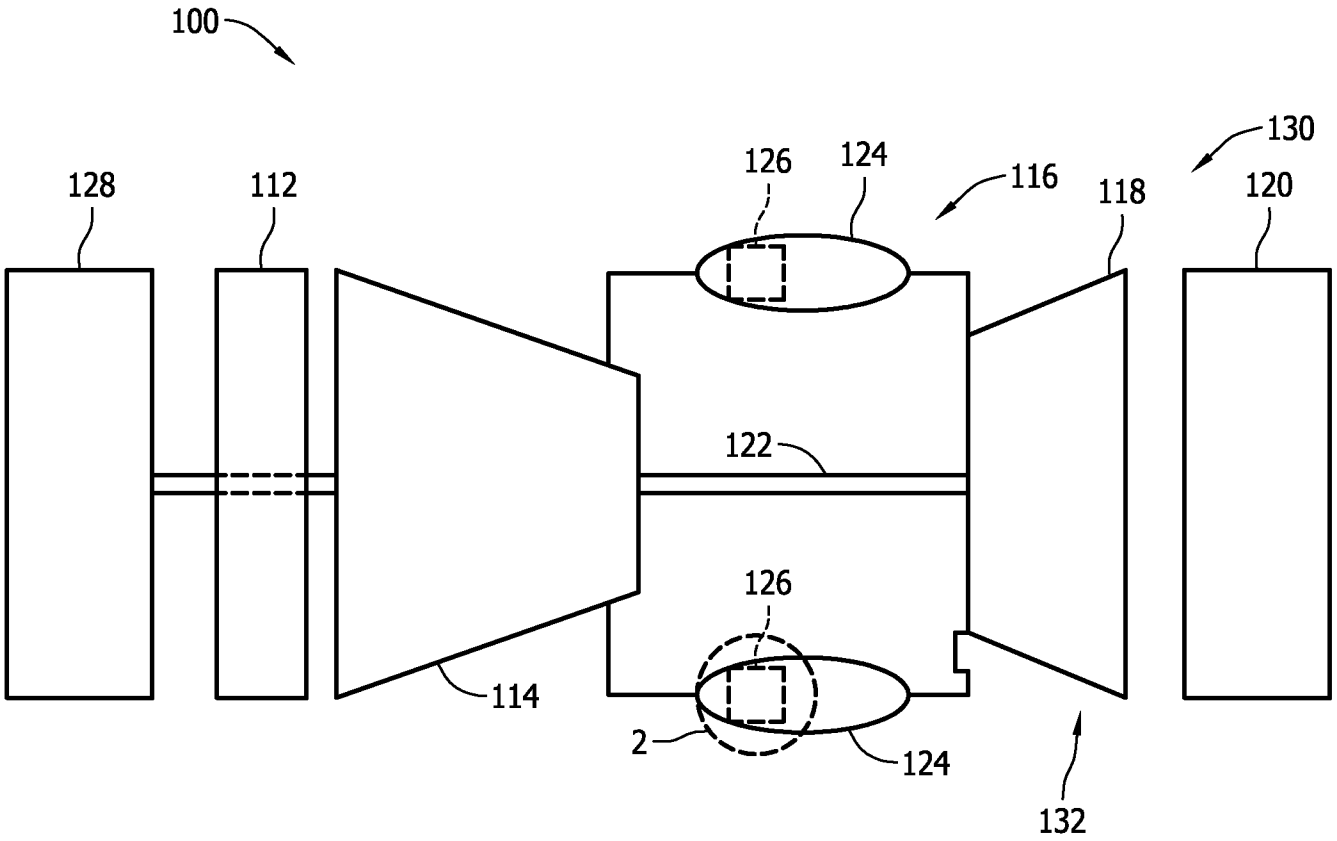
FIG. 1 is schematic diagram of an exemplary gas turbine engine.

FIG. 1 is a schematic cross-sectional view of an exemplary turbine engine 100. More specifically, turbine engine 100 is a gas turbine engine. While the exemplary embodiment illustrates a gas turbine engine, the present invention is not limited to any one particular engine, and one of ordinary skill in the art will appreciate that the current invention may be used in connection with other turbine engines.

In the exemplary embodiment, turbine engine 100 includes an intake section 112, a compressor section 114 coupled downstream from intake section 112, a combustor section 116 coupled downstream from compressor section 114, a turbine section 118 coupled downstream from combustor section 116, and an exhaust section 120. Turbine section 118 is coupled to compressor section 114 via a rotor shaft 122. In the exemplary embodiment, combustor section 116 includes a plurality of combustors 124. Combustor section 116 is coupled to compressor section 114 such that each combustor 124 is in flow communication with compressor section 114. A fuel injection nozzle 126 is coupled within each combustor 124. Turbine section 118 is coupled to compressor section 114 and to a load 128 such as, but not limited to, an electrical generator and/or a mechanical drive application. In the exemplary embodiment, each compressor section 114 and turbine section 118 includes at least one rotor disk assembly 130 that is coupled to a rotor shaft 122 to form a rotor assembly 132.

During operation, intake section 112 channels air towards compressor section 114 wherein the air is compressed to a higher pressure and temperature prior to being discharged towards combustor section 116. The compressed air is mixed with fuel and other fluids that are provided by each fuel injection nozzle 126 and ignited to generate combustion gases that are channeled towards turbine section 118. More specifically, each fuel injection nozzle 126 injects fuel, such as natural gas and/or fuel oil, air, diluents, and/or inert gases, such as Nitrogen gas ($N_2$), into respective combustors 124, and into the air flow. The fuel mixture is ignited to generate high temperature combustion gases that are channeled towards turbine section 118. Turbine section 118 converts the thermal energy from the gas stream to mechanical rotational energy, as the combustion gases impart rotational energy to turbine section 118 and to rotor assembly 132. Because fuel injection nozzle 126 injects the fuel with air, diluents, and/or inert gases, NOx emissions may be reduced within each combustor 124. The terms "upstream" and "downstream" as used herein are referenced against a direction of flow of air and fuel through the fuel injection nozzle 126 and into the combustion chamber (not shown).

Figure 2:
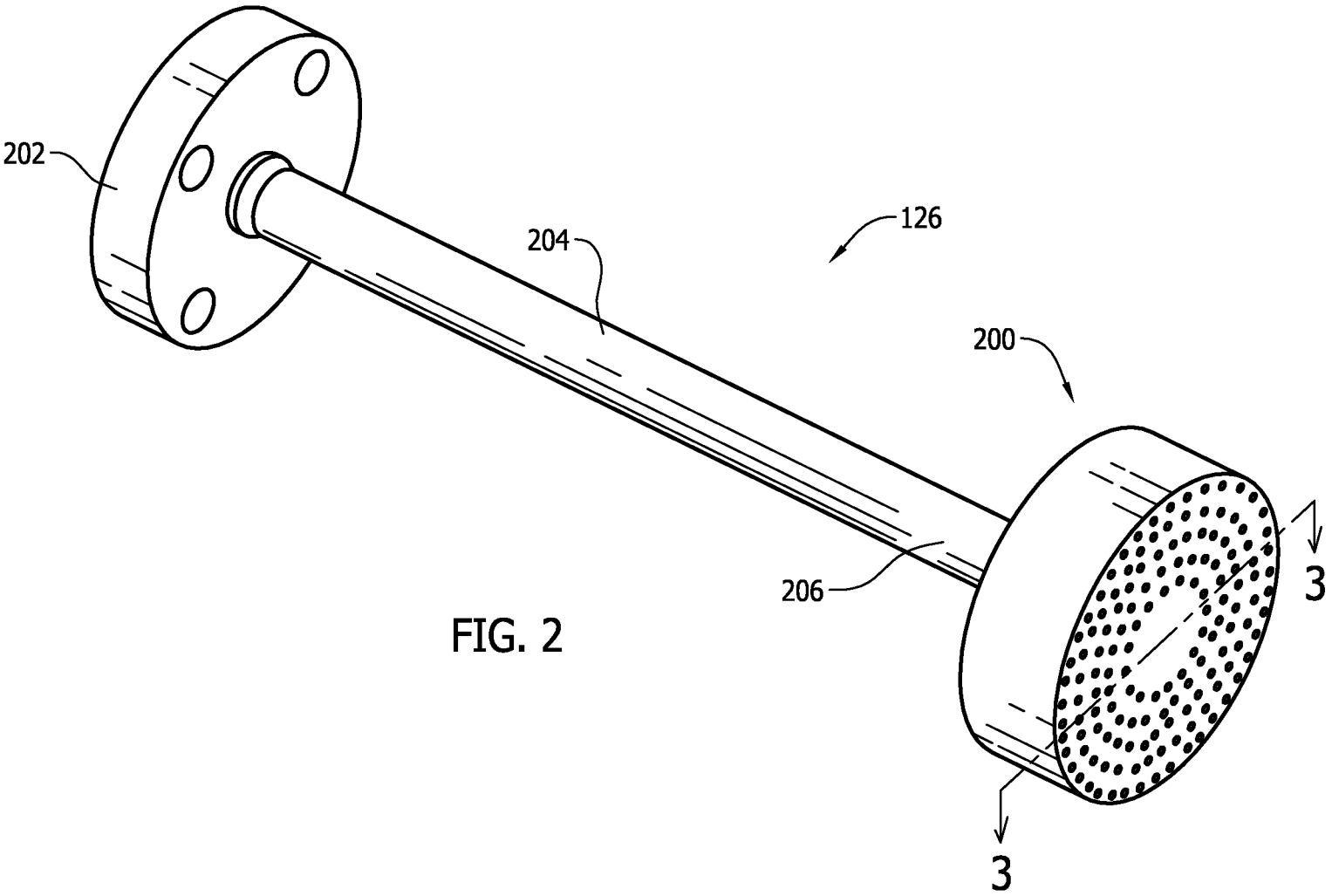
FIG. 2 is a perspective view of an exemplary fuel injection nozzle that may be used with the gas turbine engine shown in FIG. 1.

FIG. 2 illustrates a gas turbine fuel injection nozzle 126 that includes an exemplary fuel injection head 200. Specifically, nozzle 126 includes fuel injection head 200, a fuel nozzle base 202, and a fuel feed tube 204 extending between head 200 and base 202. Fuel injection head 200 is coupled to a downstream end 206 of fuel feed tube 204, such that a leading edge (not shown) of fuel feed tube 204 is against an internal, annular shoulder (not shown in FIG. 2) defined within a center 207 of fuel injection head 200.

In the exemplary embodiment, fuel injection head 200 is fabricated using an additive manufacturing process. Specifically, an additive manufacturing process known as direct metal laser sintering (DMLS) or direct metal laser melting (DMLM) is used to manufacture monolithic fuel injection head 200. Although the process is described herein as DMLS, one having ordinary skill in the art would understand that DMLM could also be used. Alternatively, the additive manufacturing method is not limited to the DMLS or DMLM process, but may be any known additive manufacturing process that enables head 200 to function as described herein. This fabrication process eliminates joints that would typically be defined between separate components that require welding or brazing. Rather, DMLS is an additive layer process that produces a metal component directly from a CAD model using a laser and a fine metal powder. In the exemplary embodiment, cobalt and/or chrome alloy powders and Nickel-based alloy powders are used to fabricate fuel injection head 200, but other powders that enables head 200 to function as described herein may be used.

The CAD model is sliced into thin layers, and the layers are then reconstructed layer by layer, such that adjacent layers are laser fused together. The layer thickness is generally chosen based on a consideration of accuracy vs. speed of manufacture. Initially, a steel plate is typically fixed inside the DMLS machine to serve as both a support and a heat sink. A dispenser delivers the powder to the support plate and a coater arm or blade spreads the powder on the plate. The machine software controls the laser beam focus and movement so that wherever the laser beam strikes the powder, the powder forms into a solid. The process is repeated layer by layer until the fabrication of the component is completed.

Figure 3:
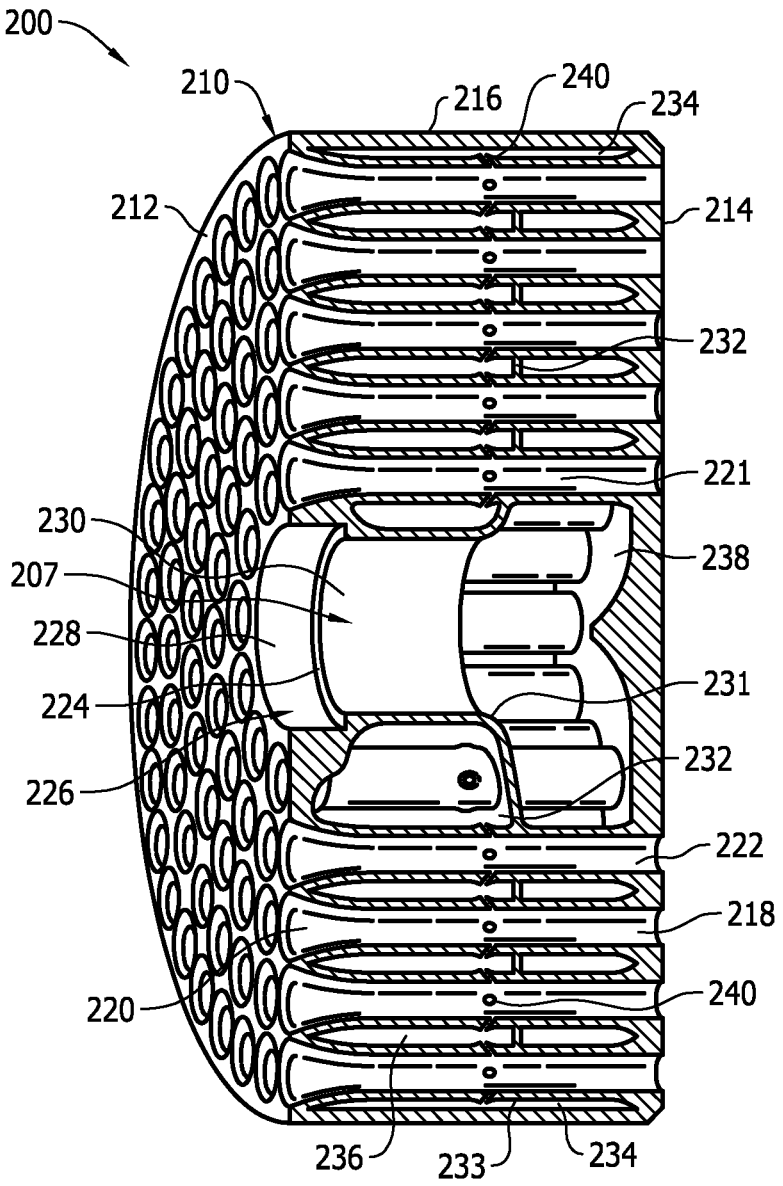
FIG. 3 is an enlarged cross-sectional perspective view of a head portion of the fuel injection nozzle shown in FIG. 2 and taken along line 3-3.

FIG. 3 is an enlarged cross-sectional perspective view of fuel injection head 200. In the exemplary embodiment, head 200 is formed as a partially hollow, substantially circular, monolithic body 210 that includes an upstream end face 212 and an opposite downstream end face 214. Faces 212 and 214 are substantially parallel to one another, and an annular peripheral wall 216 extends axially therebetween. Head 200 also includes a plurality of internal air supply passages or pre-mix tubes 218 that extend between faces 212 and 214. Each tube 218 includes an inlet 220 defined in upstream face 212 and an outlet 222 defined in downstream face 214. In the exemplary embodiment, each inlet 220 is flared outwardly such that a bell-mouth shape is formed that facilitates accelerating a flow of air into and through a fluid flow channel 221 of each pre-mix tube 218. Inlets 220 facilitate accelerating the flow air through channel 221 to substantially prevent flashback along downstream face 214. The remaining lengths of pre-mix tubes 218 have a substantially uniform diameter defined through outlets 222. Alternatively, inlets 220 may not be flared and may be sized substantially identical to outlet 222 such that each tube 218 has a constant diameter from inlet 220 to outlet 222. Moreover, inlets 220 and outlets 222 may have any shape that facilitates operation of fuel injection nozzle 126 (shown in FIG. 2) as described herein. In the exemplary embodiment, pre-mix tubes 218 may be arranged in annular, concentric rows, as shown in FIG. 2, with pre-mix tubes 218 in any given row circumferentially offset from pre-mix tubes 218 of an adjacent row. Alternatively, pre-mix tubes 218 may be arranged in any way that facilitates operation of fuel injection nozzle 126 as described herein. In addition, the use of the term "tubes" is for convenience, noting that these are not independent tubes secured at opposite ends to end faces 212 and 214, but, rather, are internal passages that are incorporated into monolithic body 210, such that interior space extends about the various passages.

In the exemplary embodiment, center 207 of fuel injection head 200, and therefore body 210, is open at upstream end face 212, and thus provides an inlet bore 226 defined by an annular wall 228. Bore 226 receives fuel feed tube 204 (shown in FIG. 2) and includes a counter-bored portion 230 that defines an annular shoulder 224. Shoulder 224 is that is coupled to the leading edge of fuel feed tube 204.

The DMLS rapid manufacturing process enables various design features to be incorporated into fuel injection head 200 that were formally very costly and time consuming to manufacture. For example, in the exemplary embodiment, monolithic body 210 includes an integrally-formed, internal baffle plate 232. Baffle plate 232 extends radially outward from a downstream end 231 of counter bore 230 to a location substantially mid-way between upstream face 212 and downstream face 214, such that most, but not all, of pre-mix tubes 218 extend therethrough. In the exemplary embodiment, baffle plate 232 is angled towards face 214 in a radially outward direction and extends from downstream end 231 of counter bore 230 towards, but not-contacting, outer peripheral wall 216. Alternatively, baffle plate 232 may extend substantially parallel to faces 212 and 214 from downstream end 231 of counter bore 230. Baffle plate 232 defines a downstream fuel plenum 238 and an upstream fuel plenum 236 that are fluidly coupled via an annular, radial gap 234 defined between a radially outer edge 233 of baffle plate 232 and peripheral outer wall 232.

In the exemplary embodiment, at least one, and preferably an array of, fuel injectors 240 is within each pre-mix tube 218. Each mixing tube 218 may include a plurality of injectors 240, such as four injectors 240 per tube 218, oriented at equally-spaced locations about the circumference of each respective tube 218. In the exemplary embodiment, fuel injectors 240 extend through a common plane that is substantially parallel to upstream face 212 and downstream face 214 of monolithic body 210, and that is upstream from baffle plate 232.

In operation, the downstream end face 214 of fuel injection head 200 is closed at center 207 such that high pressure gaseous fuel exiting fuel feed tube 204 will flow into the areas between pre-mix tubes 218 into downstream fuel plenum 238 and then through radial gap 234 into upstream plenum 236. This fuel path substantially equalizes the fuel pressure at fuel injectors 240 and thus facilitates distributing the fuel substantially uniformly to pre-mix tubes 218. The gaseous fuel will then flow through fuel injectors 240 and into pre-mix tubes 218 wherein the fuel and air will mix before exiting fuel injection head 200 into a combustion chamber (not shown).

Figure 4:
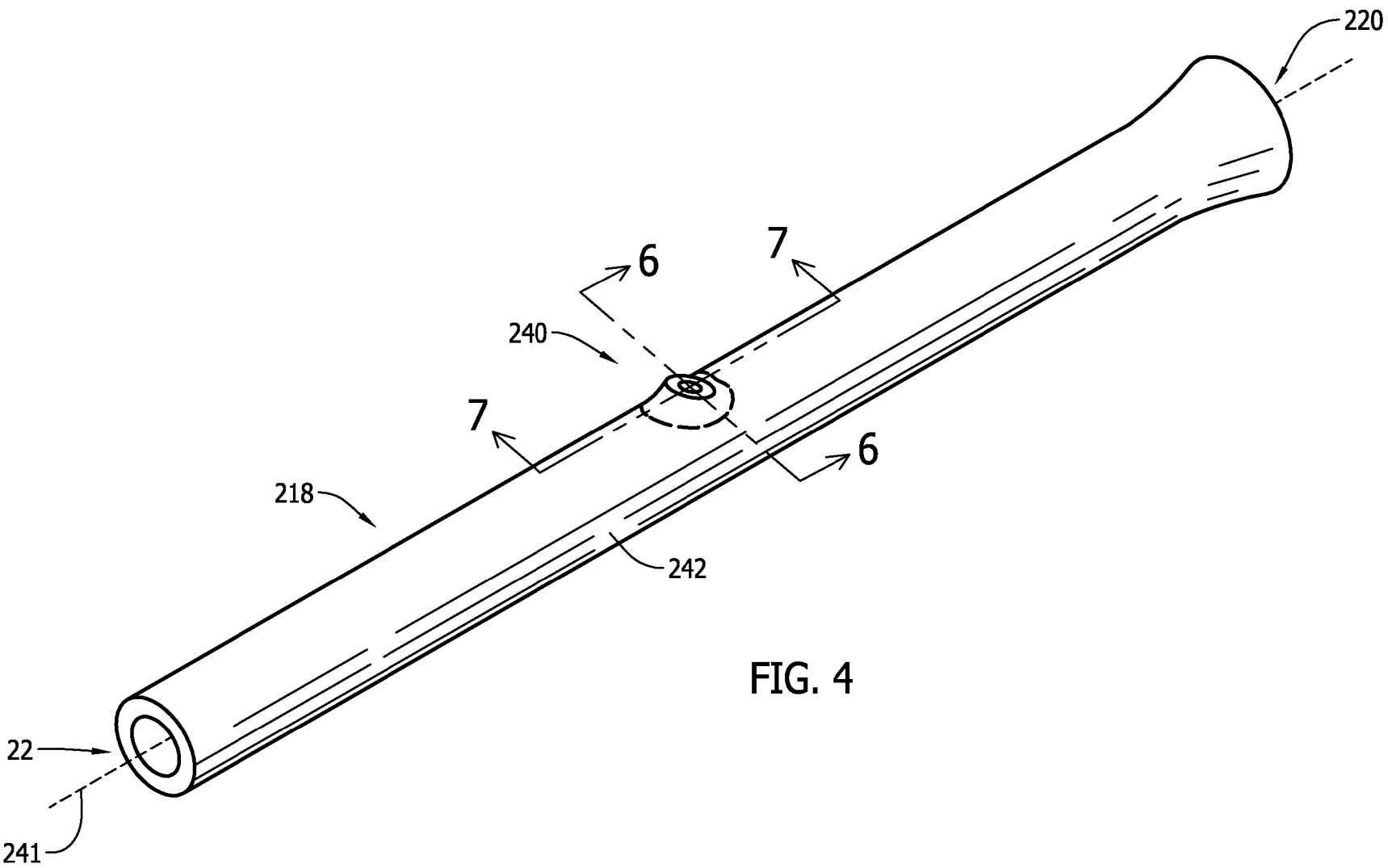
FIG. 4 is a perspective view of an exemplary pre-mix tube that may be used with the fuel injection nozzle shown in FIG. 2.
Figure 5:
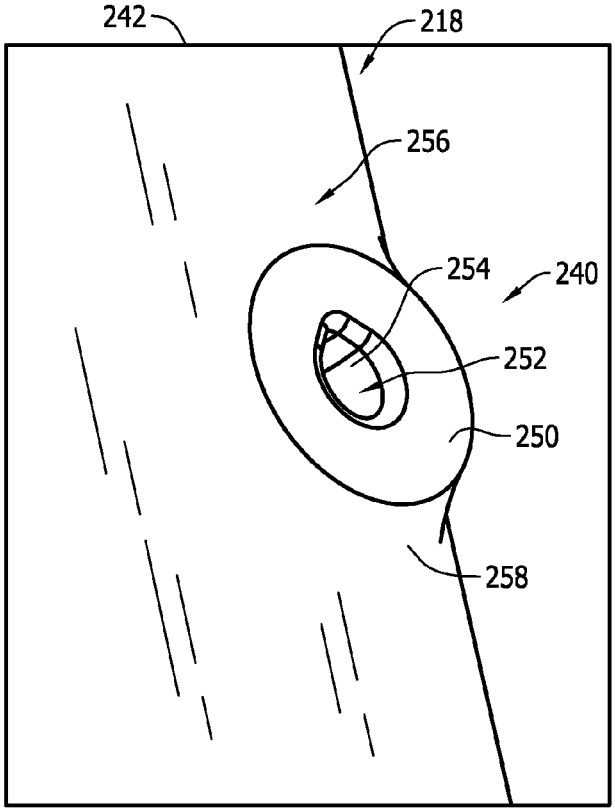
FIG. 5 is an enlarged perspective view of an exemplary fuel injector that may be used with the pre-mix tube shown in FIG. 4.
Figure 6:
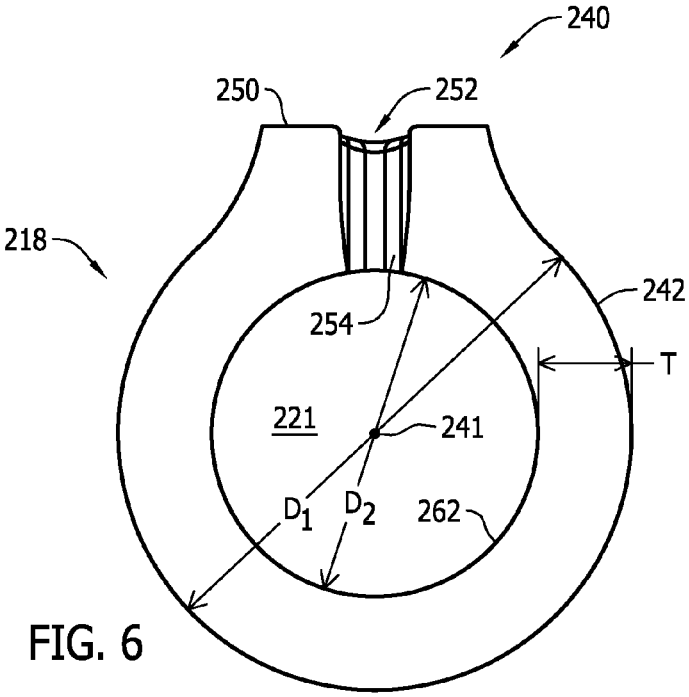
FIG. 6 is an axial cross-sectional view of the fuel injector shown in FIG. 5 and taken along line 6-6.
Figure 7:
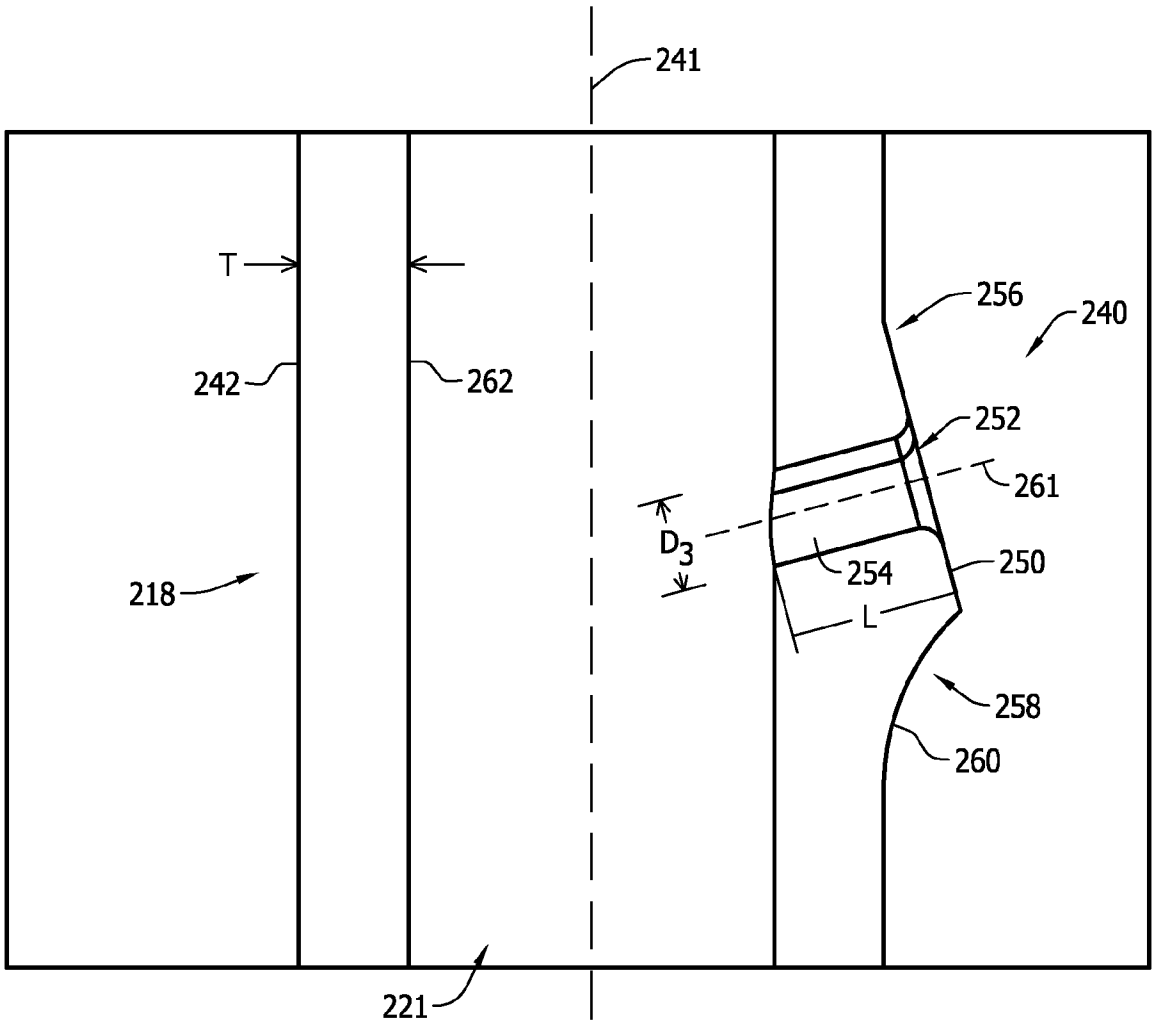
FIG. 7 is a radial cross-sectional view of the fuel injector shown in FIG. 5 and taken along line 7-7.

FIG. 4 illustrates a perspective view of an exemplary pre-mix tube 218 and fuel injector 240 that may be used with fuel injection nozzle 126. FIG. 4 also illustrates flared tube inlet 220 and a centerline axis 241 that extends through pre-mix tube 218. In the exemplary embodiment, fuel injector 240 is located on an outer wall 242 of tube 218 and is approximately mid-way between inlet 220 and outlet 222. Alternatively, fuel injector 240 may be located at any point on outer wall 242 that facilitates nozzle 126 operation as described herein. FIG. 5 shows an enlarged perspective view of fuel injector 240. FIGS. 6 and 7 are cross-sectional views of pre-mix tube 218 and fuel injector 240. Although only one fuel injector 240 is shown in each of FIGS. 4-7, each pre-mix tube 218 may include more than one fuel injector 240 as described herein.

In the exemplary embodiment, at least a portion of each fuel injector 240 extends outward from outer wall 242. Fuel injector 240 includes a substantially circular surface 250 and a fuel flow channel 254. Surface 250 includes an inlet 252 defined therein that works in combination with channel 254 to enable fuel flow communication between upstream plenum 236 and fluid flow channel 221. In the exemplary embodiment, fuel injector 240, and more specifically, channel 254, including a centerline axis 261, is oriented substantially parallel to the direction of fuel flow, such that channel 254 is oriented obliquely with respect to channel 221. Specifically, axis 261 is oriented at about a 30° angle with respect to channel axis 241. Alternatively, channel 254 may be oriented at any angle with respect to channel 221 that facilitates operation of fuel nozzle 126 as described herein. Generally, channel 254 is oriented with respect to channel 221 to ensure that the flow of fuel through channel 254 of injectors 240 has a velocity component in the direction of the air flowing through channel 221 of pre-mix tubes 218.

Furthermore, injector 240 includes an upstream end 256 and a downstream end 258 such that injector surface 250 extends at least partially between ends 256 and 258. In the exemplary embodiment, injector upstream end 256 extends outward from injector outer wall 242 at a shallow acute angle such that injector surface 250 is oriented obliquely with respect to axis 241 (best shown in FIG. 7). Downstream end 258 includes a radius of curvature 260, beginning at the downstream end of surface 250 that gradually slopes downstream end 258 of injector 240 into outer wall 242 of pre-mix tube 218. As such, downstream end 258 extends a distance outward from tube outer surface 242, with respect to axis 241, which facilitates capturing fuel flowing past inlet 252 and orienting channel 254 in the direction of fuel flow.

The DMLS process also facilitates providing an exact location and orientation of fuel injectors 240 on pre-mix tubes 218. This is important because the placement of injectors 240 determines the uniformity of the fuel feed pressure within fuel injection head 200 (shown in FIG. 3). If, for example, the fuel is flowing past inlet 252 of injector 240 at a high velocity, it will have a low feed pressure. If the fuel velocity is low on the other hand, it will have a high feed pressure. Similarly, if a first injector 240 on a first pre-mix tube 218 is directly opposite a second injector 240 on a second adjacent pre-mix tube 218, then the fuel passing inlets 252 will have high velocity and thus low feed pressure. It has been found that rotating the location of a first injector 240 on a first pre-mix tube 218 45 degrees relative to a second injector 240 on a second adjacent pre-mix tube 218 produces the best results, and the DMLS process can be manipulated to locate injectors 240 in this manner automatically and with great precision.

In the exemplary embodiment, pre-mix tube 218 includes outer wall 242 that defines an outer diameter $D_1$ and an inner wall 262 that defines inner diameter $D_2$. The difference between $D_1$ and $D_2$ defines a thickness T of pre-mix tube 218. The diameters of known pre-mix tubes are limited to the diameters of standard size tubes used in the art. However, the DMLS process enables the manufacture of customized pre-mix tube thicknesses T that are generally thinner than known pre-mix tubes. For example, in the exemplary embodiment, pre-mix tube 218 has a thickness T of approximately 0.02 inches in comparison to known pre-mix tubes having a thickness of 0.035 inches. Alternatively, pre-mix tube 218 may have any thickness that enables fuel nozzle 126 to operate as described herein. Furthermore, because of the thinner tube thickness T, fuel injection head 200 includes more pre-mix tubes 218 than previously known fuel injection heads, which facilitates better mixing of fuel and air and leads to more efficient engine operation and fewer emissions.

In the exemplary embodiment, fuel injector channel 254 includes a length L and a diameter $D_3$. A length to diameter (L/D) ratio is defined by length L divided by diameter $D_3$. Empirical evidence has shown that a larger L/D ratio results in better mixing of fuel and air in channel 221. In the exemplary embodiment, fuel injector 240 has an L/D ratio of at least 10 to 1. Fuel injector channel 254 includes length L that greater than known injector lengths not only because channel 254 is oriented at an angle, as described above, but also because fuel injector 240 extends beyond outer wall 242 of pre-mix tube 218 such that length L is greater than thickness T of tube 218. The length of previously known injector channels were limited by the thickness of their pre-mix tubes. A thicker standard tube thickness allowed for a longer injector channel, but limited the number of tubes within the injection head. However, a thinner tube thickness allowed for more tubes per head, but limited the length of the injector channel and resulted in poor mixing. In the exemplary embodiment, manufacturing fuel injection head 200 using the DMLS process facilitates optimizing both the thickness T of pre-mix tube 218 and the length L of fuel injector channel 254 to facilitate a greater number of tubes 218 each having a longer fuel injector channel 254 than known injection heads to provide efficient fuel and air mixing. Manufacturing fuel injection head 200, and more specifically pre-mix tubes 218 using the DMLS method removes current manufacturing limitations and facilitates production of complex shapes, such as fuel injector 240, at relatively low cost.

In the exemplary embodiment, inlet 252 includes various inlet conditioning features that facilitate improved mixing of fuel and air, which enable more efficient operation and lower emission production of gas turbine engine 100. For example, inlet 252 may be flared outwardly, similarly to inlet 220 (shown in FIG. 3), such that a bell-mouth shape is formed to facilitate a flow of fuel into and through fuel flow channel 254 of each injector 240. Flared inlets 252 facilitate accelerating the flow fuel through channel 254 to facilitate improved mixing of fuel and air in channel 221. The remaining length of injector 240 may have a substantially uniform diameter. Alternatively, inlets 252 are not flared such that each channel 254 has a constant diameter.

Furthermore, in the exemplary embodiment, inlet 252 may be teardrop shaped, as best seen in FIG. 5. A teardrop shape of inlet 252 enables an eddy to be induced in the flow of fuel through inlet 252 that facilitates enhancing mixing of fuel and air in channel 221. The eddy generated by inlet 252 induces turbulence in the fuel flow that facilitates mixing of fuel and air in channel 221. Alternatively, inlet 252 may be substantially circular in shape. Generally, inlet 252 may have any shape that facilitates operation of injector 240 as described herein. The DMLS process enables complex inlet conditioning features, such as inlet flaring or a teardrop shaped inlet, in a cost-effective and reliable manner that enhances pre-mixing of fuel and air and that facilitate increased engine operation efficiency.

It will thus be appreciated that using the DMLS method permits the design and construction of fuel injection nozzles that were previously not producible in a reliable or economical manner. The DMLS method ensures that the interfaces between the pre-mix tubes and end face of the injection head are sound and do not require machining to very tight braze tolerances. The jointless manufacture of the injection head is beneficial because it prevent the leakage of fuel between a gap that exists between the tubes and the end faces of known injection heads. Moreover, the DMLS technique facilitates manufacturing a pre-mix tube that has a thickness less than known tubes and that includes a fuel injector, at least a portion of which extends radially outward from the exterior surface of the pre-mix tube.

The fuel injection head and fuel injector described herein enables enhanced mixing of fuel and air in a respective pre-mix tube. The exemplary fuel injector extends outward from the exterior surface of the pre-mix tube such that a ratio of the length of the fuel injector channel to its diameter is larger than corresponding ratios of known fuel injectors. Furthermore, the exemplary fuel injector includes complex inlet conditioning features, such as flared inlets on the pre-mix tubes and injector channel and teardrop shaped injector channel inlets, which also facilitate improving fuel and air mixing in the pre-mix tube, which leads to higher engine efficiency and a decrease in engine emissions.

Exemplary embodiments of a fuel injection nozzle and methods of manufacturing the same are described above in detail. The nozzle and methods are not limited to the specific embodiments described herein, but rather, components of the nozzle and/or steps of the methods may be utilized independently and separately from other components and/or steps described herein. For example, the methods may also be used in combination with other gas turbine components and additive manufacturing methods, and are not limited to practice with only the fuel injection nozzle and DMLS method described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the description is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel injection head for use in a fuel injection nozzle, said fuel injection head comprising:

a monolithic body portion comprising an upstream face, an opposite downstream face, and a peripheral wall extending therebetween; and a plurality of pre-mix tubes extending axially through said body portion, each of said pre-mix tubes is formed integrally with said body portion, each said pre-mix tube comprises:

an inlet adjacent said upstream face;

an outlet adjacent said downstream face;

a tube channel at least partially defined by a wall extending between said inlet and said outlet, said wall comprising an inner surface and an outer surface, a thickness of said pre-mix tube is measured between said inner and outer surfaces; and at least one fuel injector integrally formed with said pre-mix tube, said fuel injector comprises a projection that extends outwardly from said outer surface of said pre-mix tube such that a thickness of said at least one fuel injector defined between a tip of said projection and said inner surface is greater than said pre-mix tube thickness, a fuel flow channel is defined through said outwardly extending projection, said fuel flow channel extends from a first end to an opposite second end, said first end extends through said inner surface and said second end extends to a fuel injector inlet defined in said projection to facilitate fuel flow between said body portion and said tube channel.

2. The fuel injection head according to claim 1, wherein said tip of said outwardly extending projection defines an injector surface, said fuel injector inlet defined in said injector surface.

3. The fuel injection head according to claim 1, wherein said fuel injector inlet is flared outwardly to facilitate accelerating fuel flow through said fuel flow channel.

4. The fuel injection head according to claim 1, wherein said fuel injector inlet is teardrop shaped.

5. The fuel injection head according to claim 1, wherein a ratio of a length of said fuel flow channel to a diameter of said fuel flow channel is at least about 10 to 1.

6. The fuel injection head according to claim 1, wherein said outwardly extending projection further comprises an upstream end extending obliquely from said pre-mix tube outer surface.

7. The fuel injection head according to claim 1, wherein said outwardly extending projection further comprises a downstream end that extends arcuately between said pre-mix tube outer surface and an injector surface defined by said outwardly extending projection.

8. The fuel injection head according to claim 1, wherein said tube channel facilitates mixing the fuel flow from said fuel flow channel and an air flow to deliver a mixture of fuel and air from said outlet.

* * * * *